United States Patent [19]

Kushibe et al.

[11] Patent Number: 4,986,247

[45] Date of Patent: Jan. 22, 1991

[54] FUEL SUPPLY DEVICE OF AN ENGINE

[75] Inventors: Takahiro Kushibe; Yuichi Takano; Manabu Tateno, all of Susono; Eishi Ohno, Mishima; Naotaka Shirabe, Nagoya, all of Japan

[73] Assignees: Toyota Jidosha Kabushiki Kaisha; Nippondenso Co., Ltd., both of Japan

[21] Appl. No.: 386,609

[22] Filed: Jul. 31, 1989

[30] Foreign Application Priority Data

| | | | |
|---|---|---|---|
| Aug. 4, 1988 | [JP] | Japan | 63-102691[U] |
| Aug. 8, 1988 | [JP] | Japan | 63-104061[U] |
| Sep. 5, 1988 | [JP] | Japan | 63-115904 |
| Dec. 26, 1988 | [JP] | Japan | 63-326124 |

[51] Int. Cl.[5] ..... F02M 67/10

[52] U.S. Cl. ..... 123/533; 239/5; 239/585

[58] Field of Search ..... 123/531, 533; 239/5, 239/585; 251/129.15

[56] References Cited

U.S. PATENT DOCUMENTS

| | | | |
|---|---|---|---|
| 1,980,743 | 11/1934 | Blanding . | |
| 4,462,760 | 7/1984 | Sarich et al. | 123/531 |
| 4,693,224 | 9/1987 | McKay | 123/531 |
| 4,771,754 | 9/1988 | Reinke | 123/533 |
| 4,794,901 | 1/1989 | Hong et al. | 123/533 |
| 4,823,756 | 4/1989 | Ziejewski et al. | 123/531 |
| 4,844,339 | 7/1989 | Sayer et al. | 239/5 |

FOREIGN PATENT DOCUMENTS

| | | |
|---|---|---|
| 0083515 | 12/1981 | European Pat. Off. . |
| 0083516 | 12/1981 | European Pat. Off. . |
| 104154 | 5/1986 | Japan . |
| 62-3168 | 1/1987 | Japan . |
| WO87/00583 | 1/1987 | PCT Int'l Appl. . |
| 8807628 | 10/1988 | PCT Int'l Appl. . |

*Primary Examiner*—Tony M. Argenbright
*Attorney, Agent, or Firm*—Oliff & Berridge

[57] ABSTRACT

A fuel supply device comprising a nozzle opening for injecting fuel and pressurized air. The opening operation of the nozzle opening is electromagnetically controlled by a needle. The nozzle of a fuel injector is arranged in a nozzle chamber. The nozzle chamber has an air inlet and an air outlet separately formed from and spaced from the air inlet. The air inlet is connected to a pressurized air source, and the air outlet is connected to the nozzle opening.

22 Claims, 12 Drawing Sheets

FUEL SUPPLY DEVICE OF AN ENGINE

BACKGROUND OF THE INVENTION

1. Field of the Invention

The present invention relates to a fuel supply device of an engine.

2. Description of the Related Art

In a known so-called "air blast" valve, the opening and closing operation of the nozzle opening is electromagnetically controlled by a needle to inject fuel by pressurized air. A pressurized air passage extending from the nozzle opening along the needle is formed around the needle and connected to a pressurized fuel source. A nozzle chamber which is open to the pressurized air passage is provided, and the nozzle of the fuel injector is arranged at the deep interior of the nozzle chamber. After fuel is injected from the fuel injector toward the needle, the needle opens the nozzle opening, whereby the fuel thus injected is injected from the nozzle opening of the air blast valve together with pressurized air (see International Publication No. W087/00583). In this air blast valve, it is possible to obtain a good atomization of fuel by pressurized air of low pressure.

However, where the nozzle of the fuel injector is arranged at the deep interior of a nozzle chamber which is open to the pressurized air passage, as in the above-mentioned air blast valve, when the needle opens the nozzle opening, the pressurized air does not substantially flow within the nozzle chamber. As a result, since the fuel stuck to the inner wall of the nozzle chamber cannot be carried away by the pressurized air, a problem occurs in that the injected fuel will accumulate within the nozzle chamber.

SUMMARY OF THE INVENTION

An object of the present invention is to provide a fuel supply device capable of injecting the entire fuel, injected from the fuel injector, from the nozzle opening of the fuel supply device.

According to the present invention, there is provided a fuel supply device of an engine, including: a nozzle opening for injecting fuel and pressurized air; valve means for electromagnetically controlling the opening operation of the nozzle opening; a nozzle chamber having an air inlet connected to a pressurized air source and having an air outlet separately formed from and spaced from the air inlet and connected to the nozzle opening; and fuel injection means arranged in the nozzle chamber for injecting fuel.

The present invention may be more fully understood from the description of preferred embodiments of the invention set forth below, together with the accompanying drawings.

DESCRIPTION OF PREFERRED EMBODIMENTS

Figure 2:
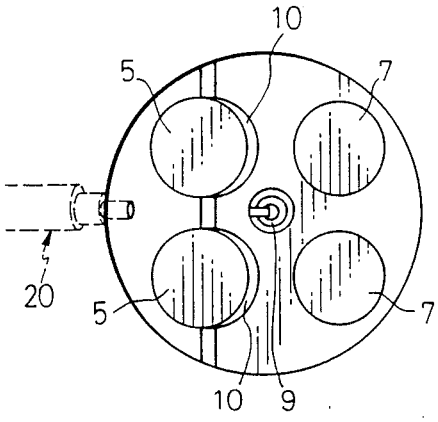
FIG. 2 is a bottom view of the inner wall of the cylinder head of a two-stroke engine.
Figure 3:
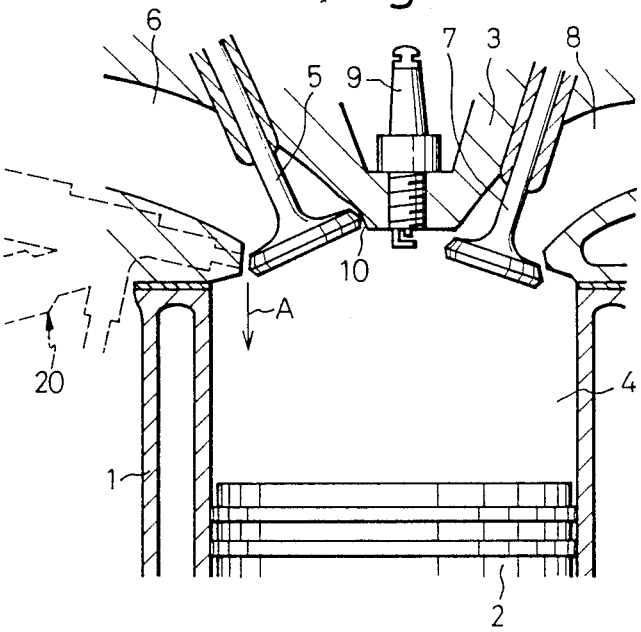
FIG. 3 is a cross-sectional side view of the two-stroke engine.

Referring to FIGS. 2 and 3, reference numeral 1 designates a cylinder block, 2 a piston, 3 a cylinder head, and 4 a combustion chamber; 5 designates a pair of intake valves, 6 intake ports, 7 a pair of exhaust valves, 8 exhaust ports; and 9 designates a spark plug. Masking walls 10, each masking the valve opening formed between the valve seat and the peripheral portion of the intake valve 5, which is located on the exhaust valve side, for the entire time for which the intake valve 5 is open, are formed on the inner wall of the cylinder head 3. Consequently, when the intake valves 5 open, fresh air flows into the combustion chamber 4 from the valve opening which is located at a position opposite to the exhaust valves 7, as illustrated by the arrow A in FIG. 3. An air blast valve 20 is arranged on the inner wall of the cylinder head 3 between the intake valves 5.

Figure 1:
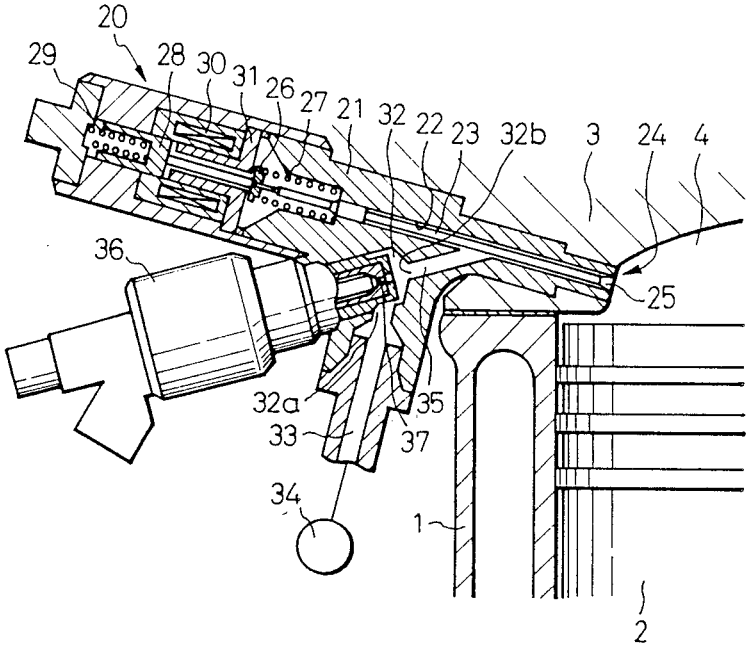
FIG. 1 is a partly cross-sectional side view of an air blast valve.

FIG. 1 illustrates a first embodiment of the air blast valve 20. Referring to FIG. 1, a straight needle insertion bore 22 is formed in the housing 21 of the air blast valve 20, and a needle 23 having a diameter smaller than that of the needle insertion bore 22 is inserted into the needle insertion bore 22. A nozzle opening 24 is formed at one end of the needle insertion bore 22, and the opening and closing operation of the nozzle opening 24 is carried out by the valve head 25 formed on the tip of the needle 23. In the embodiment illustrated in FIG. 1, the nozzle opening 24 is arranged in the combustion chamber 4. A spring retainer 26 is mounted on the needle 23, and a compression spring 27 is inserted between the spring retainer 26 and the housing 21. The nozzle opening 24 is normally closed by the valve head 25 of the needle 23 due to the spring force of the compression spring 27. A movable core 28 continuously abuts against the end portion of the needle 23, which is positioned opposite to the valve head 25, due to the spring force of the compression spring 27, and a solenoid 30 and a stator 31 are arranged in the housing 21 to attract the movable core 28. When the solenoid 30 is energized, the movable core 28 moves toward the stator 31. At this time, since the needle 23 moves toward the nozzle opening 24 against the compression spring 27, the nozzle opening 24 is opened.

A nozzle chamber 32 having a cylindrical shape is formed in the housing 21. The nozzle chamber 32 has an air inlet 32*a* and an air outlet 32*b* separately formed from and spaced from the air inlet 32*a*. The air inlet 32*a* is connected to a pressurized air source 34 via a pressurized air inflow passage 33, and the air outlet 32*b* is connected to the needle insertion bore 22 via a pressurized air outflow passage 35. The nozzle 37 of a fuel injector 36 is arranged in the nozzle chamber 32 at a position between the air inlet 32*a* and the air outlet 32*b*.

As can be seen from FIG. 1, the pressurized air outlet passage 35 extends straight. The nozzle 37 of the fuel injector 36 is arranged on the axis of the pressurized air outlet passage 35, and fuel having a small spread angle is injected from the nozzle 37 along the axis of the pressurized air outflow passage 35. The pressurized air outlet passage 35 extends obliquely to the needle insertion bore 22 toward the nozzle opening 24 and is obliquely connected to the needle insertion bore 22 at an angle of 20 through 40 degrees with respect to the axis of the needle insertion bore 22.

The needle insertion bore 22, the nozzle chamber 32, and the pressurized air outflow passage 35 are connected to the pressurized air source 34 via the pressurized air inflow passage 33 and thus filled with pressurized air. Fuel is injected into the pressurized air from the nozzle 37 along the axis of the pressurized air outflow passage 35. Since the pressurized air outflow passage 35 is obliquely connected to the needle insertion bore 22, a large part of the injected fuel reaches the interior of the needle insertion bore 22 around the needle 23 near the valve head 25. At this time, a part of the injected fuel is stuck to both the inner wall of the pressurized air outflow passage 35 and the inner wall of the nozzle chamber 32. When the solenoid 30 is energized, the needle 23 opens the nozzle opening 24. At this time, since the injected fuel is collected near the valve head 25, both the fuel and the pressurized air are injected together from the nozzle opening 24 into the combustion chamber 4 (FIG. 3) as soon as the needle 23 opens the nozzle opening 24. In addition, when the needle 23 opens the nozzle opening 24, pressurized air flows into the nozzle chamber 32 from the pressurized air inflow passage 33 and then flows toward the nozzle opening 24 via the pressurized air outflow passage 35. Consequently, the fuel stuck to the inner wall of the pressurized air outflow passage 35 and the inner wall of the nozzle chamber 32 is carried away by the pressurized air and then injected from the nozzle opening 24. Therefore, as soon as the needle 23 opens the nozzle opening 24, the entire injected fuel is injected from the nozzle opening 24 and, after the injection of the entire injected fuel is completed, only the pressurized air is injected from the nozzle opening 24. Then, the solenoid 30 is deenergized, and thus the needle 23 closes the nozzle opening 24. Consequently, only the pressurized air is injected from the nozzle opening 24 immediately before the needle 23 closes the nozzle opening 24.

If fuel is still injected from the nozzle opening 24 immediately before the needle 23 closes the nozzle opening 24, when the flow area of the nozzle opening 24 becomes small due to the closing operation of the needle 23, and the velocity of the pressurized air flowing out from the nozzle opening 24 becomes low, the fuel is not atomized, and thus the liquid fuel is stuck to the wall around the nozzle opening 24. However, if the liquid fuel is stuck to the wall around the nozzle opening 24, carbon is accumulated on the wall around the nozzle opening 24 and affects the injecting operation. Nevertheless, in the embodiment illustrated in FIG. 1, since only the pressurized air is injected from the nozzle opening 24 immediately before the needle 23 closes the nozzle opening 24, the liquid fuel is not stuck to the wall around the nozzle opening 24, and therefore there is no danger that carbon will be accumulated on the wall around the nozzle opening 24.

FIG. 3 illustrates the case where the air blast valve 20 is used for a two-stroke engine, and the injection of fuel by the air blast valve 20 is started a little while before the intake valves 5 close. When the engine is operating under a light load, since the velocity of the fresh air A flowing into the combustion chamber 4 is low, the fuel injected from the air blast valve 20 is collected around the spark plug 9, and thus a good ignition can be obtained. When the engine is operating under a heavy load, since the velocity of the fresh air A flowing into the combustion chamber 4 is high, a strong loop scavenging operation is carried out. In addition, since the fuel injected from the air blast valve 20 is carried downward along the inner wall of the combustion chamber 4 by the fresh air A flowing in a loop shape, a homogenous air-fuel mixture is formed in the combustion chamber 4. As a result, a high output power of the engine can be obtained.

Figure 4:
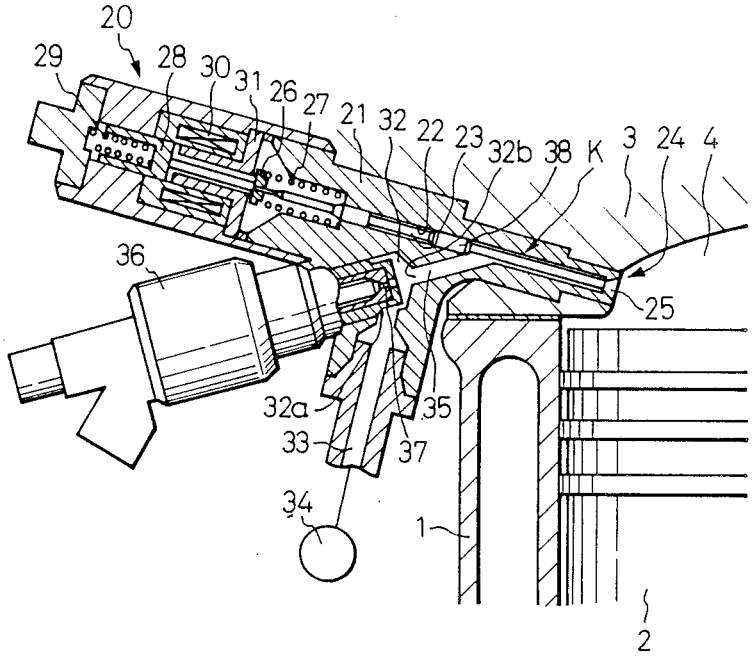
FIG. 4 is a partly cross-sectional side view of another embodiment of the air blast valve.
Figure 5:
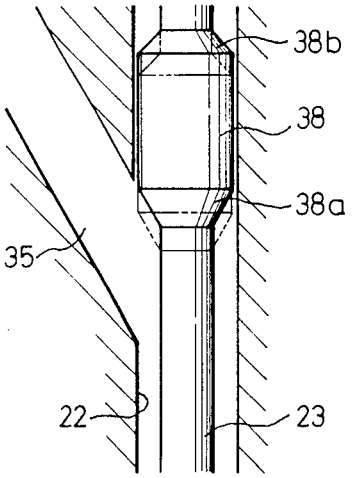
FIG. 5 is an enlarged cross-sectional side view of a portion of the air blast valve, illustrated by the arrow K in FIG. 4.

FIGS. 4 and 5 illustrate another embodiment. In this embodiment, an enlarged portion 38 closing the entire cross-section of the needle insertion bore 22 is integrally formed on the needle 23 at a position adjacent to the connecting portion between the pressurized air outflow passage 35 and the needle insertion bore 22 and opposite to the nozzle opening 24. In this embodiment, the enlarged portion 38 has a cylindrical shape and has conical end faces 38*a* and 38*b* at the opposed ends thereof. The solid line in FIG. 5 illustrates the position of the enlarged portion 38 wherein the needle 23 is in the closed position, and the dashed and dotted line in FIG. 5 illustrates the position of the enlarged portion 38 wherein the needle 23 is in the open position. Consequently, as can be seen from FIG. 5, when the needle 23 is in the closed position, the lower end face 38*a* of the enlarged portion 38 is positioned at the same level as the upper edge of the opening of the pressurized air outflow passage 35 at the connecting portion between the pressurized air outflow passage 35 and the needle insertion bore 22 and, when the needle 23 opens the nozzle opening 24, the lower portion of the enlarged portion 38 partially closes the opening of the pressurized air outflow passage 35.

By forming the enlarged portion 38 on the needle 23, when fuel is injected from the nozzle 37 of the fuel injector 36, the enlarged portion 38 prevents the injected fuel from entering into the deep interior of the needle insertion bore 22, that is, entering into the needle insertion bore 22 located above the enlarged portion 38 in FIG. 4, and prevents the injected fuel from being stuck to the inner wall of the deep interior of the needle insertion bore 22. Consequently, the entire fuel injected from the nozzle 37 can be injected from the nozzle opening 24. In addition, when the needle 23 opens the nozzle opening 24, the enlarged portion 38 moves toward the nozzle opening 24. At this time, the fuel stuck onto the inner wall of the needle insertion bore 22 near the enlarged portion 38 is wiped off by the lower end face 38*a* of the enlarged portion 38. Consequently, it is possible to prevent the fuel from accumulating on the inner wall of the needle insertion bore 22 near the enlarged portion 38.

In addition, the enlarged portion 38 also serves to retain the needle 23 at a regular position in the needle insertion bore 22.

Figure 6:
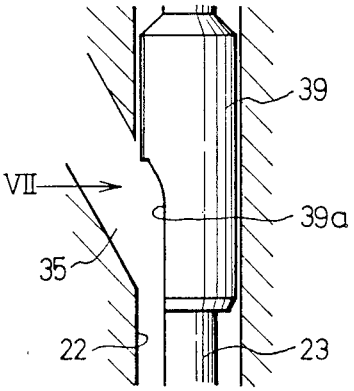
FIG. 6 is an enlarged cross-sectional side view of another embodiment of a portion of the air blast valve.
Figure 7:
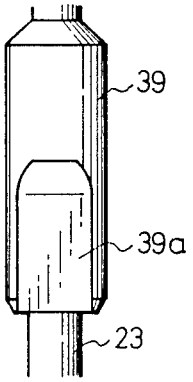
FIG. 7 is a side view of the needle, looking along the arrow VII in FIG. 6.

FIGS. 6 and 7 illustrate another embodiment of the enlarged portion formed on the needle 23. In this embodiment, the enlarged portion 39 of the needle 23 is arranged to cover the opening of the pressurized air outflow passage 35, and a cutaway portion 39*a* is formed on the outer circumferential wall of the enlarged portion 41 at a position which faces the opening of the pressurized air outflow passage 35. In this embodiment, since the fuel injected from the nozzle 37 (FIG. 4) impinges upon the surface of the cutaway portion 41*a, which has a small surface area, the amount of fuel stuck to the wall around the opening of the pressurized air outflow passage 35 becomes small. Consequently, in this embodiment, there is an advantage that the amount of the injected fuel which reaches the needle insertion bore 22 near the valve head 25 can be increased.*

Figure 8:
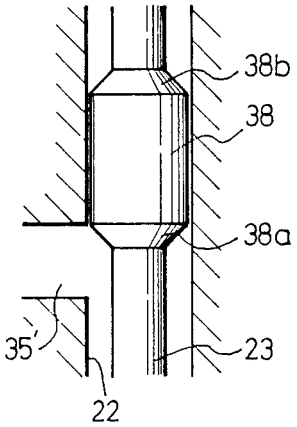
FIG. 8 is an enlarged cross-sectional side view of a further embodiment of a portion of the air blast valve.

FIG. 8 illustrates the case where the pressurized air outflow passage 35' is connected to the needle insertion bore 22 at a right angle.

FIGS. 9 through 13 illustrates a further embodiment of the air blast valve.

Figure 9:
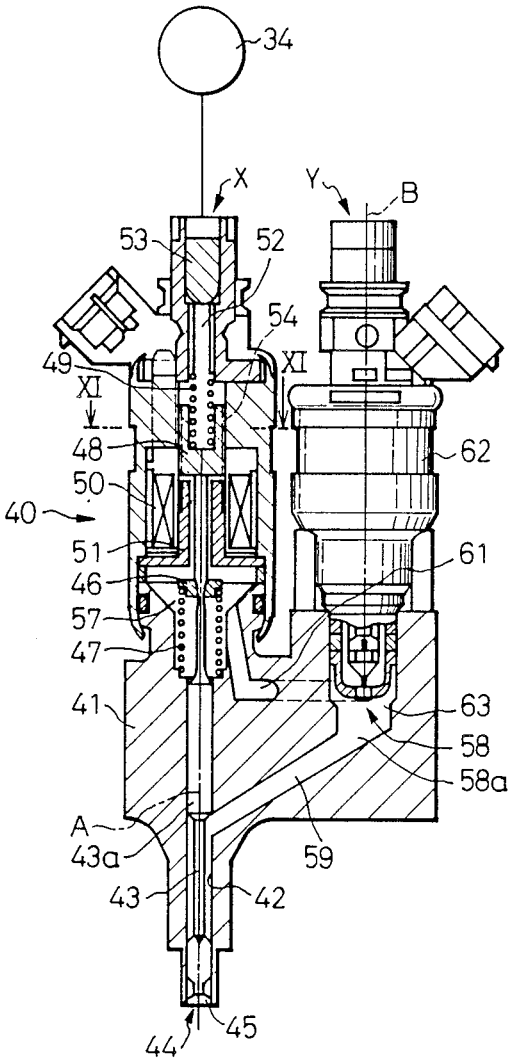
FIG. 9 is a partly cross-sectional side view of a further embodiment of the air blast valve.

Referring to FIG. 9, in this embodiment, a straight needle insertion bore 42 is formed in the housing 41 of the air blast valve 40, and a needle 43 having a diameter smaller than that of the needle insertion bore 42 is inserted into the needle insertion bore 42. A nozzle opening 44 is formed at one end of the needle insertion bore 42, and the opening and closing operation of the nozzle opening 44 is carried out by the valve head 45 formed on the tip of the needle 43. Also in the embodiment illustrated in FIG. 9, the nozzle opening 44 is arranged in the combustion chamber 4 (FIG. 3). A spring retainer 46 is mounted on the needle 43, and a compression spring 47 is inserted between the spring retainer 46 and the housing 41. The nozzle opening 44 is normally closed by the valve head 45 of the needle 43 due to the spring force of the compression spring 47. A movable core 48 continuously abuts against the end portion of the needle 43, which is positioned opposite to the valve head 45, due to the spring force of the compression spring 47, and a solenoid 50 and a stator 51 are arranged in the housing 41 to attract the movable core 48. When the solenoid 50 is energized, the movable core 48 moves toward the stator 51. At this time, since the needle 43 moves toward the nozzle opening 44 against the compression spring 47, the nozzle opening 44 is opened.

Figure 11:
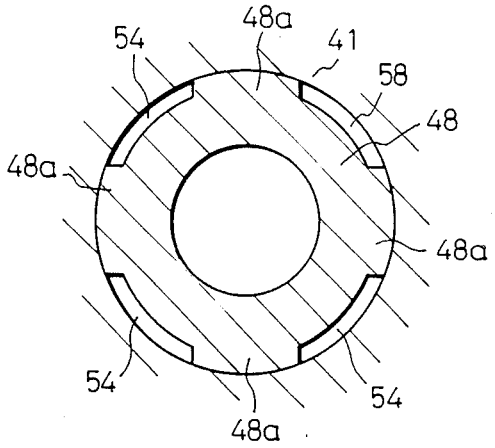
FIG. 11 is an enlarged cross-sectional plan view of the movable core, taken along the line XI—XI in FIG. 9.

A pressurized air introduction passage 52 is formed in the housing 41 at a position opposite to the valve head 45 and extends on the axis A of the needle insertion bore 42. This pressurized air introduction passage 52 is connected to the pressurized air source 34 via a strainer 53. Referring to FIG. 11 which is an enlarged cross-sectional plan view of the movable core 58, a plurality of projections 48*a* having a cylindrical outer face are equiangularly formed on the outer circumferential wall of the movable core 48, and a plurality of air passages 54 extending along the axis A are formed between the outer face of the movable core 48 and the inner wall of the housing 41 and between the projections 48*a*.

Figure 12:
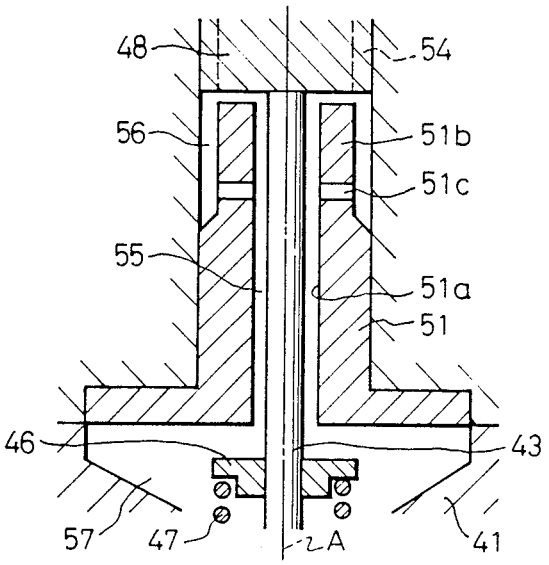
FIG. 12 is an enlarged cross-sectional side view of the stator illustrated in FIG. 9.

Referring to FIG. 12 which illustrates the enlarged cross-sectional side view of the stator 51, a bore 51*a* extending on the axis A and having a diameter larger than that of the needle 43 is formed in the stator 51, and an annular air passage 55 is formed between the needle 43 and the inner wall of the bore 51*a*. A spring chamber 57 receiving the compression spring 47 therein is formed in the housing 41 beneath the stator 51, and the annular air passage 55 is connected to the spring chamber 57. The stator 51 has a reduced diameter portion 51*b* at the upper portion thereof, and thus an annular air passage 56 is formed between the outer wall of the reduced diameter portion 51*b* and the inner wall of the housing 41. A plurality of radially extending bores 51*c* are formed in the reduced diameter portion 51*b* to connect the annular air passage 56 to the annular air passage 55. Consequently, as can be seen from FIGS. 9, 11, and 12, the pressurized air introduction passage 52 is connected to the spring chamber 57 via the air passages 54, the annular air passage 56, the bores 51*c* and the annular air passage 55. Therefore, the air passages 54, 55, 56 and the spring chamber 57 are filled with pressurized air.

Figure 10:
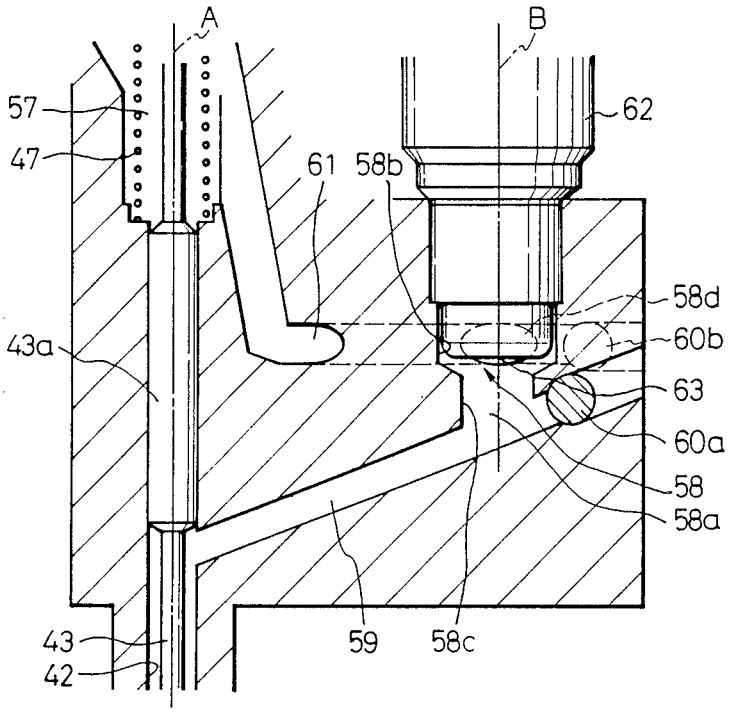
FIG. 10 is an enlarged cross-sectional side view of a portion of the air blast valve illustrated in FIG. 9.

Referring to FIGS. 9 and 10, the needle 43 has an enlarged portion 43*a* formed at the central portion thereof and slidably fitted into the needle insertion bore 42, and thus the pressurized air in the spring chamber 59 does not directly flow into the needle insertion bore 42 beneath the enlarged portion 43*a* due to the presence of the enlarged portion 43*a*.

A nozzle chamber 58 having a cylindrical shape is formed in the housing 41 so that the axis B of the nozzle chamber 58 is parallel to the axis A of the needle insertion bore 42. As illustrated in FIG. 10, this nozzle chamber 58 has a reduced diameter portion 58*c* at the lower portion thereof and has an increased diameter portion 58*b* at the upper portion thereof. In addition, this nozzle chamber 58 has an air inlet 58*d* formed on the inner circumferential wall of the increased diameter portion 58*b* and has an air outlet 58*a* formed at the bottom of the reduced diameter portion 58*c*.

Figure 13:
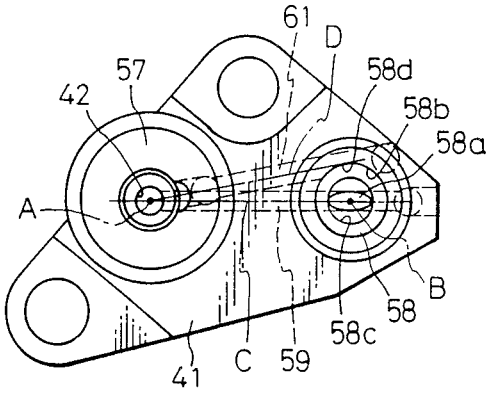
FIG. 13 is a plan view of the air blast valve illustrated in FIG. 9, with the upper elements being removed.

Referring to FIGS. 9, 10, and 13, the air inlet 58*d* of the nozzle chamber 58 is connected to the spring chamber 57 via a pressurized air inflow passage 61 which initially extends from the air inlet 58*d* in a plane perpendicular to the axis B and then extends upward toward the spring chamber 57. As illustrated in FIG. 13, the pressurized air inflow passage 61 is tangentially connected to the nozzle chamber 58 so that the axis D of the pressurized air inflow passage 61 coincides with a tangent of the increased diameter portion 58*d*, and the air inlet 58*b* is formed at the intersecting portion of the pressurized air inflow passage 61 and the nozzle chamber 58. By arranging the pressurized air inflow passage 61 so that the axis D thereof coincide with a tangent of the increased diameter portion 58*d*, it is possible to maximize the flow area of the air inlet 58*d*.

The air outlet 58*a* of the nozzle chamber 58 is connected to the needle insertion bore 42 at a position adjacent to the lower end face of the enlarged portion 43*a* of the needle 43 via a pressurized air outflow passage 59. This pressurized air outflow passage 59 extends straight so that the axis C thereof intersects with both the axis A and B as illustrated in FIG. 13. In addition, as can be seen from FIG. 10, the pressurized air inflow passage 59 extends from the air outlet 58*a* at an angle slightly larger than 90°, for example, 110°, relative to the axis B and is obliquely connected to the needle insertion bore 42. Outer ends of the pressurized air outflow passage 59 and the pressurized air inflow passage 61 are closed by blind plugs 60*a* and 60*b*, respectively.

The nozzle 63 of a fuel injector 62 is arranged in the nozzle chamber 58 at a position between the air inlet 58*d* and the air outlet 58*a*. In addition, the fuel injector 62 and the nozzle 63 are arranged on the axis B. Fuel having a small spread angle is injected from the nozzle 63 along the axis B. This fuel impinges upon the wall of the pressurized air outflow passage 59 at a high speed. At this time, a part of the fuel is instantaneously atomized, and a part of the fuel forms an emulsion.

The pressurized air inflow passage 61, the nozzle chamber 58, the pressurized air outflow passage 59, and the needle insertion bore 42 beneath the enlarged portion 43*a* are connected to the spring chamber 57 and thus filled with pressurized air. Consequently, the fuel is injected from the nozzle 63 along the axis B into the pressurized air and impinges upon the wall of the pressurized air outflow passage 59. At this time, as mentioned above, a part of the fuel is atomized, and a part of the fuel forms an emulsion. The atomized fuel remains in the nozzle chamber 58 and the pressurized air outflow passage 59, and the emulsified fuel is stuck to the wall of the nozzle chamber 58 and the wall of the pressurized air outflow passage 59. Consequently, at this time, an extremely small amount of the fuel is introduced into the needle insertion bore 42 near the valve head 45 of the needle 43.

When the solenoid 50 is energized, the needle 43 opens the nozzle opening 44. At this time, as soon as the needle 43 opens the nozzle opening 44, an extremely small amount of the fuel existing in the needle insertion bore 42 near the valve head 45 is injected into the combustion chamber 4 (FIG. 3) from the nozzle opening 44. In addition, when the needle 43 opens the nozzle opening 44, the pressurized air flows into the nozzle chamber 58 from the pressurized air inflow passage 61 via the air inlet 58*d* and then flows toward the nozzle opening 44 via the pressurized air outflow passage 59. At this time, the fuel emulsified and stuck to the inner walls of the nozzle chamber 58 and the pressurized air outflow passage 59 is atomized by the pressurized air flowing within the nozzle chamber 58 and the pressurized air outflow passage 59 and then carried away, while mixing the pressurized air, toward the nozzle opening 44 by the pressurized air. Then, this fuel is injected from the nozzle opening 44.

As mentioned above, when the needle 43 opens the nozzle opening 44, an extremely small amount of the fuel existing in the needle insertion bore 42 is initially injected from the nozzle opening 45. However, immediately thereafter, the fuel fully atomized and fully mixed with the air is injected from the nozzle opening 44. Consequently, the fuel fully atomized and fully mixed with the air is injected from the nozzle opening 44 from the beginning of air-fuel injecting operation, and thus it is possible to form a good air-fuel mixture in the combustion chamber 4 (FIG. 3).

In addition, as mentioned earlier, since the pressurized air inflow passage 61 is tangentially connected to the inner wall of the nozzle chamber 58, the pressurized air flows within the nozzle chamber 58 while swirling along the inner wall of the nozzle chamber 58. As a result, the fuel stuck to the inner wall of the nozzle chamber 58 is fully atomized and then carried away by the swirling pressurized air. After the entire fuel injected from the nozzle 63 is injected from the nozzle opening 44, only the pressurized air is injected from the nozzle opening 44. Then, the solenoid 50 is deenergized, and the needle 43 closes the nozzle opening 44.

If a large amount of fuel exists in the needle insertion bore 42 near the valve head 45, this fuel is pushed out in the form of liquid fuel by the pressurized air when the needle 43 opens the nozzle opening 44. As a result, a good combustion cannot be obtained. However, in the embodiment illustrated in FIG. 9, since the fuel existing in the needle insertion bore 42 is extremely small, a good combustion can be obtained.

In addition, as can be seen from FIG. 9, since the fuel injector 62 is arranged so that the axis B thereof is parallel to the axis A, the air inlet X and the fuel inlet Y are arranged adjacent to each other and at the same level. Consequently, where a plurality of the air blast valves 40 are mounted on the engine, the arrangement of the air delivery pipe to be connected to the air inlets X and the arrangement of the fuel delivery pipe to be connected to the fuel inlets Y become easy.

In addition, since the valve head 45 of the needle 43 is exposed to the combustion gas, the temperature of the valve head 45 becomes high. The heat of the valve head 45 is transferred to the solenoid 50 via the needle 43, the movable core 48 and the stator 51, and thus the temperature of the solenoid 50, becomes high. However, in the embodiment illustrated in FIG. 9, since the movable core 48, the stator 51, and the needle 43 are cooled by the pressurized air, an increase in the temperature of the solenoid 50 is suppressed, and thus there is no danger that the solenoid 50 will be damaged.

FIGS. 14 through 18 illustrate various modifications of the arrangement or the shape of the pressurized air inflow passage 61, the nozzle chamber 58, and the pressurized air outflow passage 59.

Figure 14:
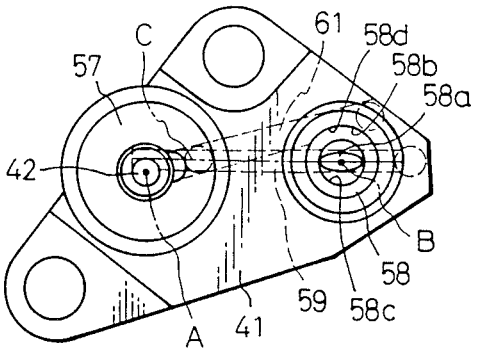
FIG. 14 through 16 are a plan view of various separate embodiments of the air blast valve, with the upper elements being removed.

In the embodiment illustrated in FIG. 14, the pressurized air outflow passage 59 is tangentially connected to the needle insertion bore 42 so that the axis C thereof intersects with the axis B and coincides with a tangent of the inner wall of the needle insertion bore 42. In this embodiment, it is possible to maximize the flow area of the opening of the pressurized air outflow passage 59, which opening is open to the needle insertion bore 42, and it is possible to cause the pressurized air to swirl in the needle insertion bore 42.

Figure 15:
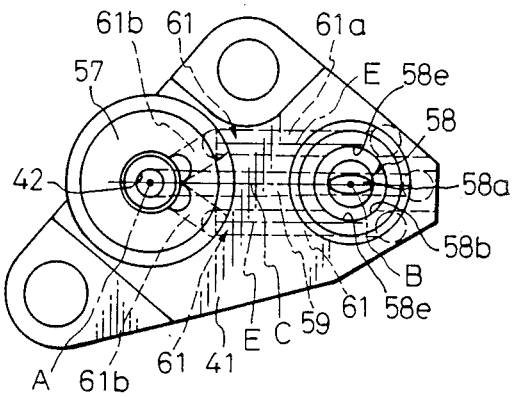

In the embodiment illustrated in FIG. 15, a pair of pressurized air inlet passages 61 are provided and arranged symmetrically with respect to the vertical plane including the axis C. Each of the pressurized air inlet passages 61 comprises a passage portion 61*a* having an air inlet 58*e* which is open to the nozzle chamber 58, and a passage portion 61*b* connecting the passage portion 61*a* to the spring chamber 57. Each of the passage portions 61*a* is tangentially connected to the inner wall of the nozzle chamber 58 so that the axis E of the passage portion 61*a* coincides with a tangent of the inner wall of the nozzle chamber 58. In this embodiment, since the pressurized air flows entering the nozzle chamber 58 from the air inlets 58*e* come into violent contact with each other, a strong turbulence is created in the nozzle chamber 58, and thus it is possible to promote the atomization of the fuel stuck to the inner wall of the nozzle chamber 58.

Figure 16:
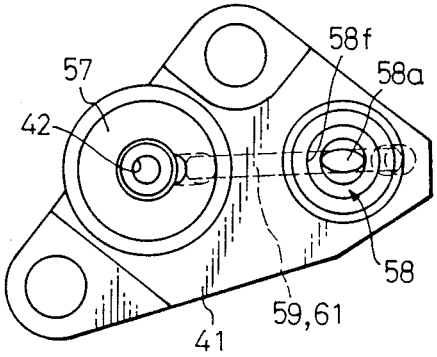

In the embodiment illustrated in FIG. 16, the pressurized air inlet passage 61 and the pressurized air outflow passage 59 are arranged in the same vertical plane. Consequently, in this embodiment, the air outlet 58*f* of the pressurized air inflow passage 61 is open to the nozzle chamber 58 toward the center thereof.

Figure 17:
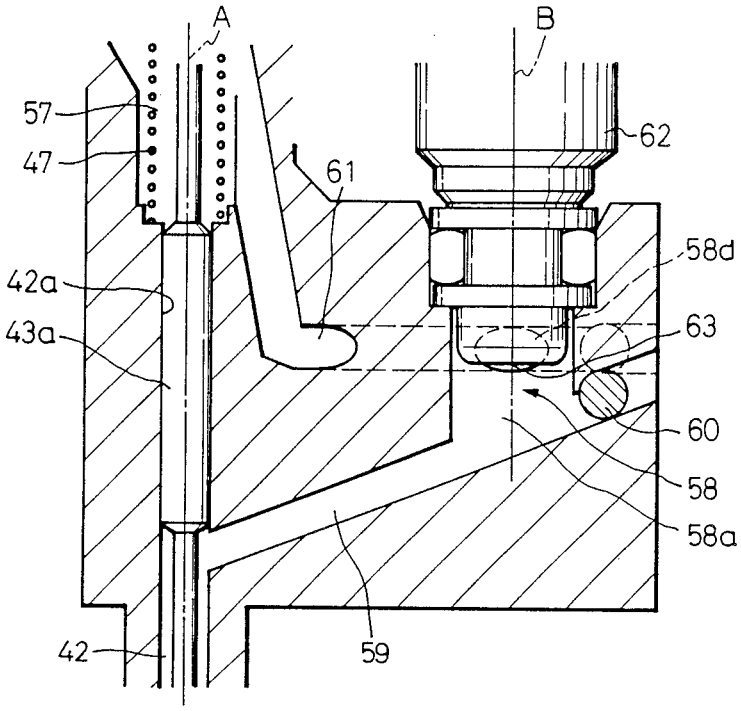
FIG. 17 is an enlarged cross-sectional side view of another embodiment of a portion of the air blast valve.

In the embodiment illustrated in FIG. 17, the nozzle chamber 58 has a uniform inner diameter over the entire length thereof.

Figure 18:
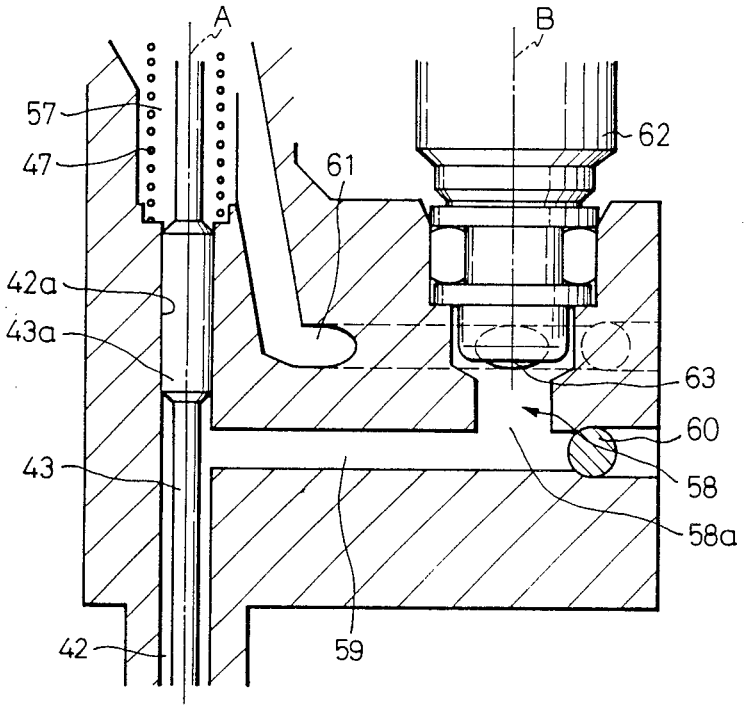
FIG. 18 is an enlarged cross-sectional side view of a further embodiment of a portion of the air blast valve.

In the embodiment illustrated in FIG. 18, the pressurized air outflow passage 59 extends from the air outlet 58*a* of the nozzle chamber 58 at a right angle with respect to the axis B. In this embodiment, it is possible to reduce the amount of fuel introduced into the needle insertion bore 42 before the needle 43 opens the nozzle opening 44 (FIG. 9).

Figure 19:
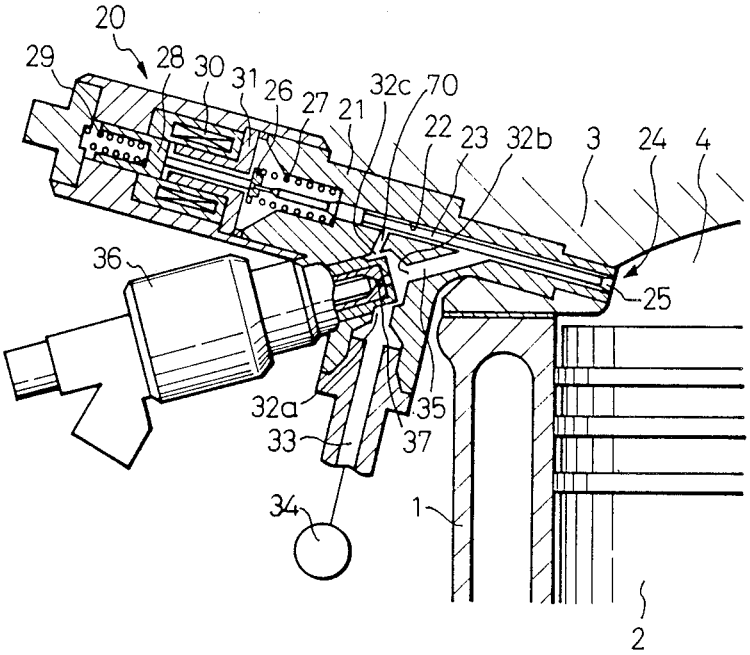
FIG. 19 is a partly cross-sectional side view of a still further embodiment of the air blast valve.

FIG. 19 illustrates a further embodiment of the air blast valve. In this embodiment, in addition to the air outlet 32*b*, another air outlet 32*c* is formed on the inner circumferential wall of the nozzle chamber 32 at a position opposite to the air inlet 32*a* with respect to the axis of the pressurized air outflow passage 35. This air outlet 32*c* is obliquely connected to the nozzle insertion bore 22 via a bypass passage 70 so that the distance between the nozzle opening 24 and the connecting portion of the pressurized air outlet passage 35 and the needle insertion bore 22 is approximately one half of the distance between the nozzle opening 24 and the connecting portion of the bypass passage 70 and the needle insertion bore 22.

Also in this embodiment, fuel is injected from the nozzle 37 of the fuel injector 36 into the pressurized air outflow passage 35. At this time, a large part of the injected fuel is introduced into the needle insertion bore 22 near the valve head 25 of the needle 23, but a small part of the injected fuel flowing out from the pressurized air outflow passage 35 flows into the deep interior of the needle insertion bore 22. However, in this embodiment, when the needle 23 opens the nozzle opening 24, since the pressurized air is fed into the needle insertion bore 22 from both the pressurized air outflow passage 35 and the bypass passage 70, the fuel existing in the deep interior of the needle insertion bore 22 is carried away toward the nozzle opening 24 by the pressurized air fed into the needle insertion bore 22 from the bypass passage 70. As a result, this makes it possible to prevent the fuel from accumulating in the deep interior of the needle insertion bore 22.

According to the present invention, since the entire fuel injected from the fuel injector is injected from the nozzle opening together with the pressurized air, there is no danger that the amount of fuel injected from the nozzle opening becomes irregular, and thus it is possible to obtain stable combustion.

While the invention has been described by reference to specific embodiments chosen for purposes of illustration, it should be apparent that numerous modifications could be made thereto by those skilled in the art without departing from the basic concept and scope of the invention.

We claim:

1. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said valve means comprises a needle arranged in a needle insertion bore having a diameter larger than that of said needle to control the opening operation of said nozzle opening formed at a tip end of said needle insertion bore, and said air outlet is connected to said needle insertion bore via a pressurized air outflow passage, said pressurized air outflow passage being tangentially connected to an inner wall of said needle insertion bore.

2. A fuel supply device according to claim 1, wherein an axis of said pressurized air outflow passage coincides with a tangent of the inner wall of said needle insertion bore.

3. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said valve means comprises a needle arranged in a needle insertion bore having a diameter larger than that of said needle to control the opening operation of said nozzle opening formed at a tip end of said needle insertion bore, and said air outlet is connected to said needle insertion bore via a pressurized air outflow passage, said needle having an enlarged portion formed thereon and slidably fitted into said nozzle insertion bore at a position opposite to said nozzle opening with respect to a connecting portion of said pressurized air outflow passage and said needle insertion bore.

4. A fuel supply device according to claim 3, wherein said pressurized air outflow passage extends from said air outlet toward said nozzle opening and is obliquely connected to said needle insertion bore.

5. A fuel supply device according to claim 3, wherein said pressurized air outflow passage is connected to said needle insertion bore at a right angle.

6. A fuel supply device according to claim 3, wherein said valve means further comprises a solenoid actuating said needle and a valve head formed on said needle to control the opening operation of said nozzle opening.

7. A fuel supply device according to claim 3, wherein said enlarged portion has an end face which is positioned adjacent to said connecting portion of said pressurized air outflow passage and said needle insertion bore.

8. A fuel supply device according to claim 7, wherein said end face of said enlarged portion has a conical shape.

9. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said valve means comprises a needle arranged in a needle insertion bore having a diameter larger than that of said needle to control the opening operation of said nozzle opening formed at a tip end of said needle insertion bore, and said air outlet is connected to said needle insertion bore via a pressurized air outflow passage, said needle having an enlarged portion formed thereon and slidably fitted into said nozzle insertion bore at a connecting portion of said pressurized air outflow passage and said needle insertion bore, and said enlarged portion having a cutaway portion connecting said pressurized air outflow passage to said nozzle opening.

10. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said valve means comprises a needle arranged in a needle insertion bore having a diameter larger than that of said needle to control the opening operation of said nozzle opening formed at a tip end of said needle insertion bore, and said air outlet is connected to said needle insertion bore via a pressurized air outflow passage, and wherein said nozzle chamber has another air outlet which is connected to said needle insertion bore via a bypass passage at a position opposite to said nozzle opening with respect to a connecting portion of said pressurized air outflow passage and said needle insertion bore.

11. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said nozzle chamber has an inner circumferential wall circumferentially extending about an axis of said nozzle chamber, and said air inlet is formed on the circumferential wall of said nozzle chamber, said air outlet being formed on the axis of said nozzle chamber and connected to said nozzle opening via a pressurized air outflow passage which extends straight on the axis of said nozzle chamber, and wherein:

said fuel injection means comprises a nozzle arranged on the axis of said nozzle chamber to inject fuel from said nozzle into said pressurized air outflow passage along the axis of said nozzle chamber, said valve means comprises a needle arranged in a needle insertion bore having a diameter larger than that of said needle to control the opening operation of said nozzle opening which is formed at a tip end of said needle insertion bore, said pressurized air outflow passage being connected to said needle insertion bore, and said nozzle chamber has another air outlet formed on the inner circumferential wall of said nozzle chamber and connected to said needle insertion bore via a bypass passage at a position opposite to said nozzle opening with respect to a connecting portion of said pressurized air outflow passage and said needle insertion bore.

12. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said nozzle chamber has an inner circumferential wall circumferentially extending about an axis of said nozzle chamber, said air inlet is formed on the circumferential wall of said nozzle chamber, said air outlet is formed on the axis of said nozzle chamber and is connected to said nozzle opening via a pressurized air outflow passage which extends laterally to the axis of said nozzle chamber, and said fuel injection means comprises a nozzle for injection fuel toward a wall of said pressurized air outflow passage.

13. A fuel supply device according to claim 12, wherein said pressurized air outflow passage extends obliquely to the axis of said nozzle chamber.

14. A fuel supply device according to claim 12, wherein said pressurized air outflow passage extends at a right angle to the axis of said nozzle chamber.

15. A fuel supply device according to claim 12, wherein said nozzle of said fuel injection means is arranged on the axis of said nozzle chamber to inject fuel from said nozzle along the axis of said nozzle chamber.

16. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said nozzle chamber has an inner circumferential wall circumferentially extending about an axis of said nozzle chamber, and said air inlet is formed on the circumferential wall of said nozzle chamber and is connected to said pressurized air source via a pressurized air inflow passage which is tangentially connected to the inner circumferential wall of said nozzle chamber at said air inlet, said air outlet being formed on the axis of said nozzle chamber.

17. A fuel supply device according to claim 16, wherein said fuel injection means comprises a nozzle arranged on the axis of said nozzle chamber to inject fuel from said nozzle along the axis of said nozzle chamber.

18. A fuel supply device according to claim 16, wherein an axis of said pressurized air inflow passage coincides with a tangent of the inner circumferential wall of said nozzle chamber.

19. A fuel supply device according to claim 16, wherein said nozzle chamber has another air inlet formed on the inner circumferential wall of said nozzle chamber and connected to said pressurized air source via another pressurized air inflow passage which is tangentially connected to the inner circumferential wall of said nozzle chamber at said other air inlet.

20. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said nozzle chamber comprises an increased diameter portion and a reduced diameter portion, and said air inlet is formed on an inner circumferential wall of said increased diameter portion which extends about an axis of the nozzle chamber, said air outlet being formed on the axis of said nozzle chamber in said reduced diameter portion.

21. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said valve means comprises a needle for controlling the opening operation of said nozzle opening, and said air inlet is connected to said pressurized air source via an air passage formed around said needle.

22. A fuel supply device of an engine, comprising:

a nozzle opening for injecting fuel and pressurized air;

valve means for electromagnetically controlling the opening operation of said nozzle opening;

a nozzle chamber having an air inlet connected to a pressurized air source and having an air outlet separately formed from and spaced from said air inlet and connected to said nozzle opening; and fuel injection means arranged in said nozzle chamber for injecting fuel, wherein said valve means comprises a needle for controlling the opening operation of said nozzle opening, and said fuel injection means comprises a fuel injector, an axis of said needle being parallel to an axis of said fuel injector.

* * * * *

UNITED STATES PATENT AND TRADEMARK OFFICE

CERTIFICATE OF CORRECTION

PATENT NO. : 4,986,247

DATED : January 22, 1991

INVENTOR(S) : Takahiro Kushibe; Yuichi Takano; Manabu Tateno; Eishi Ohno and Naotaka Shirabe It is certified that error appears in the above-identified patent and that said Letters Patent is hereby corrected as shown below:

ON TITLE PAGE:

Item [30] "Foreign Application Priority Data", please change

"Sep. 5, 1988 [JP] Japan ..... 63-115904" to

--Sep. 5, 1988 [JP] Japan ..... 63-115904[U]--

Signed and Sealed this

Seventh Day of July, 1992

*Attest:*

*Attesting Officer*

DOUGLAS B. COMER

*Acting Commissioner of Patents and Trademarks*